United States Patent [19]

Reinke et al.

[11] 4,147,569

[45] Apr. 3, 1979

[54] METHOD OF HEATING OF AT LEAST TWO ELONGATED TUBULAR METALLIC OBJECTS

[75] Inventors: Friedhelm Reinke, Remscheid; Friedhelm Emde, Hückeswagen; Herbert Geisel, Remscheid-Lüttringhausen; Rolf Gies, Remscheid; Friedrich Müller-Axt, Dusseldorf-Angermund; Klaus Lange, Duisburg; Manfred Schoenen, Mettmann, all of Fed. Rep. of Germany

[73] Assignee: AEG-Elotherm, GmbH, Remscheid-Hasten, Fed. Rep. of Germany

[21] Appl. No.: 758,337

[22] Filed: Jan. 10, 1977

[30] Foreign Application Priority Data

Jan. 9, 1976 [DE] Fed. Rep. of Germany ..... 2600626

[51] Int. Cl.[2] ..... C21D 9/14

[52] U.S. Cl. ..... 148/128; 148/144; 148/150; 148/153; 148/154; 148/156; 432/11

[58] Field of Search ..... 148/150, 153, 155, 156, 148/134, 144, 143, 154, 128; 432/11

[56] References Cited

U.S. PATENT DOCUMENTS

| | | | |
|---|---|---|---|
| 1,959,344 | 5/1934 | Coberly | 148/143 |
| 3,915,763 | 10/1975 | Jennings et al. | 148/150 |

*Primary Examiner*—R. Dean

*Attorney, Agent, or Firm*—Cushman, Darby & Cushman

[57] ABSTRACT

A process for heating at least two metal pipes wherein each pipe is individually preheated in response to sensors detecting its initial temperature and wall thickness. The pipe then passes through a continuous heater which applies an equal amount of energy to each portion of the pipe, after which each pipe emerges having a predetermined temperature independent of both its initial temperature and the wall thickness.

2 Claims, 1 Drawing Figure

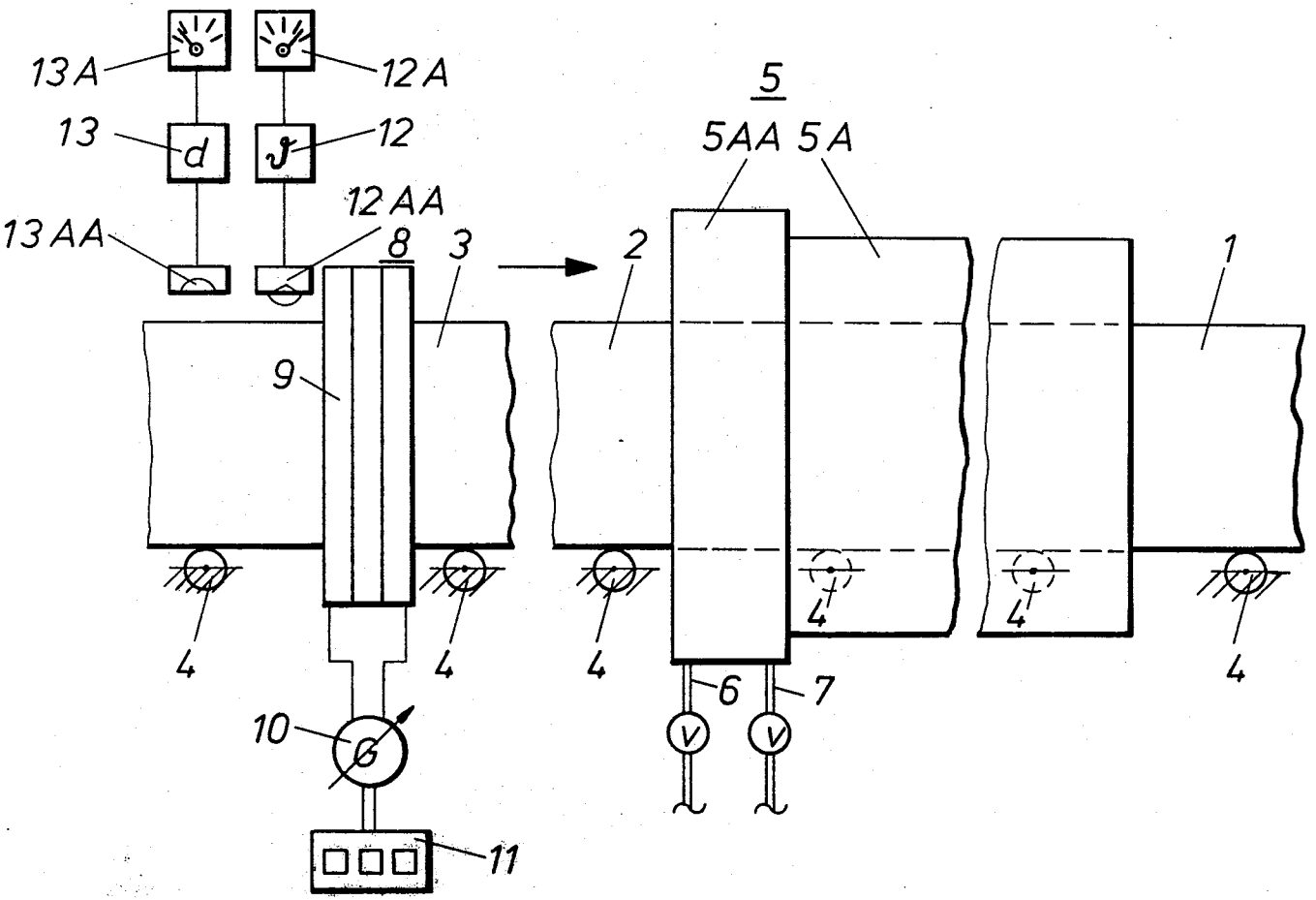
1
2
3
4
5
5A
5AA
6
7
8
9
10
11
12
12A
12AA
13
13A
13AA

METHOD OF HEATING OF AT LEAST TWO ELONGATED TUBULAR METALLIC OBJECTS

The invention relates to a process for the heating of at least two metal pipes of finite length, especially made of steel, for the purpose of heat treatment (tempering, annealing, quenching etc.) of their pipe material by supply of heat during the passage of the pipes through a heating route, in case of which the pipes pass through the heating route at a small or not distance along their longitudinal direction and at the same speed of conveyance in such a way, that said heating route will heat at least part-lengths of two immediately succeeding pipes simultaneously, and in case of which furthermore the individual pipes are heated by the supply of heat from an actual temperature to a rated temperature, the same for all pipes.

For the tempering of steel pipes by means of a fuel-heated continuous heating furnace which envelops the pipes along their longitudinal axis, the pipes are heated by means of the continuous heating furnace to a rated temperature, the tempering temperature of the material, from the rated temperature, they are quenched, by means of a cooling station, connected on the outlet side with the continuous heating furnace, through which (cooling station) the pipes pass at the speed of conveyance in the continuous heating furance, and by spraying with cooling water, to a suitably low temperature and then they are again—and in the reverse movement—heated and tempered in the continuous heating furnace. The result of this heat treatment is essentially determined by the temperatures assumed by the individual pipes during heating. Thus it is necessary in case of quench hardening, to heat all pipes which are made of the same raw material to the rated temperature in such a way, that the final temperatures of the individual pipes at the end of the heating process will be dispersed merely within a relatively narrow tolerance interval. Runaways, the final temperatures of which lie outside this tolerance interval, are possibly subject to a decrease in quantity of the heat treatment process, as a result of which the pipes might become unuseable.

In order to bring about a uniform quality of the heat treatment, pipes of equal dimensions are heated in the heating route in direct succession, i.e., with a slight or with no interval, at a predetermined speed of conveyance and predetermined heating output to a rated temperature, which results solely from the mass of the pipe material, its speed of conveyance in the furnace and the heating output of the furnace. Deviations f. ex., of the thickness of the pipe wall from a rated measure, show themselves immediately as deviations of the final temperature from the rated temperature, so that pipes, the thickness of the wall of which f. ex., deviates more considerably from the rated wall thickness, will have to be heated in the heating route at a different speed of conveyance. The heating with a different speed of conveyance or different heating output narrows down, however the pass-through capacity of the continuous heating furnace in an uneconomical manner. The individual pipes must be heated at a greater mutual distance in such a way, that they pass through the furnace at a variable speed of passage or else at a variable heating output of the furnace. Also differences of the original heat content of the individual pipes, which, in the case of otherwise equal dimensions of the pipe, show themselves through variable wall temperatures, may be balanced out thus.

The invention deals with the task of improving the profitability of the heating process of a series of metal pipes, which are fed to a heating route and have different heating capacities and/or heat contents, in such a way, that the pipes, during their passage through the heating route at equal speed of conveyance and maintaining a slight or even in case of no distance between adjacent pipes in the heating route, with the supply of larger quantities of heat, the control and adjustment of which is only possible with difficulty, are heated to the same rated temperature, with a relatively narrow tolerance.

This task is solved according to the invention with the use of a process of the initially described kind, through the fact, that the individual pipes are individually preheated by means of a preheating furnace prior to their being fed to the heating route in order to balance out a variable heat requirement.

The preheating by means of a preheating furnace, may be used to equalize variable heat capacities (dimensions of the wall thickness etc.) and/or to balance out differences in the original heat content of the individual pipes. Pipes, which f. ex., have different temperatures in case of equal dimensions, are brought to the same starting temperature by heating the colder pipes, prior to their being fed to the heating route. Pipes, the wall thickness of which exceeds a standard wall thickness, are correspondingly preheated in order to equalize the variable heat requirement because of varying heat capacity, prior to their being fed to the heating route, so that the individual pipes in the heating route, having the same speed of conveyance, will be heated to the same rated temperature, even if the heating route will heat several variable pipes, or at least partial lengths of two adjacent pipes uniformly at the same time.

In a further development of the invention, the proposal is made to carry out the preheating in the continuous process by means of a continuous heating furnace, the heating output of which is changeable.

The proposal is made furthermore, to carry out the prehating in the continuous process by inductive electric heating of the pipe walls, as a result of which a quick adaptation of the heating output of the preheating furnace to the individual characteristics of the individual pipes is possible.

The process according to the invention is explained in more detail subsequently on the basis of a drawing which shows an arrangement for carrying out the process of the invention.

The numbers 1, 2 and 3 designate several steel pipes of f. ex., 20 m length and a diameter of about 1.60 m, the wall thickness of which fluctuates considerably within certain predetermined limits.

The pipes are fed on rolls 4—possibly rotating around their axis—to a continuous, f. ex., 50 m long, heating furnace 5, which consists of a fuel-heated high performance step 5AA and a secondary heating step 5A following said first step and heated by exhaust gases of the step 5AA. The high performance burners of the step 5AA are heated via the fuel lines 6 and 7 in a regulated quantity with gaseous fuel in such a way that the step 5AA produces an essentially constant amount of heat per time unit.

A second continuous heating furnace 8 precedes the furnace 5 directly, which has the form of an induction furnace with an induction coil 9. The coil 9 comprises, just like the steps 5AA, the outside jackets of the pipes, and a.c. current of a suitable frequency from an a.c. generator 10 is fed to the coil 9, the output of which is adjustable stepwise, f. ex., by operation of the keys of an adjusting device 11.

A measuring arrangement 12 is assigned to the continuous heating furnace 8 in order to determine the surface temperature of the pipes fed to the furnace 8, with an optical temperature tracer 12AA and a recording instrument 12A and a measuring arrangement 13 for the determination of the wall thickness of the pipe, with a tracer 13AA for the thickness of the wall in the form of a meter for the running time, which determine the thickness of the material by the running time of a supersonic wave through the material of the pipe, and with a recording device 13A.

For the heat treatment of the tempered steel pipes the walls of which have previously been heated to the tempering temperature of the pipe material, and which had then been tempered thoroughly martensitically in a quenching station, and which are to be improved by tempering, the individual pipes, the wall thickness of which in case of an essentially constant mean outside diameter may fluctuate such, that the mass available per unit of length changes within wide limits, is guided first past the measuring arrangements 12AA or 13AA, so that the operator can determine by observing the instruments 12A and 13A what surface temperatures the individual pipes have and what wall thicknesses are to be noted. The pertinent measuring values, which are assigned to certain classes of measuring values, are fed to the control device 11 by the operation of keys, which (control device) changes the output of the a.c. current generator 10 by pressure on a key, which (output) is preprogrammed in dependence on the measuring values on the measuring instruments 12A and 13A, in such a way, that the heating of that pipe which just passes through the induction furnace 8 takes place such, that—including the constant output of the fuel-heated continuous heating furnace 5—the pipe material will have the rated temperature, required for the heat treatment at the exit of the continuous heating furnace 5. Pipes, the surface temperature and wall thickness of which are to be assigned to minimal or maximal border values, are not preheated by means of the continuous heating furnace 8. Only such pipes, the heat content of which is too small and the wall thickness of which exceeds a certain minimum wall thickness, are preheated such, that all pipes will have the same rated temperature at the outlet of the continuous heating surface 5.

For the control it will be effective to dispose an additional measuring arrangement for finding the temperature of the pipe material, at the outlet of the continuous heating furnace 5 or at that point of the section of passage, where the material is to have the same rated temperature.

Using the process explained, it will be possible—independently of the heat requirements of the individual pipes—to convey the pipes at equal speed and at a slight or no distance between pipes, through the continuous heating furnace 5. It will be advantageous, that the length—pointing in the direction of conveyance of the pipes—of the continuous heating furnace 8, serving for preheating, may be kept short. In case of development of the continuous heating furnace 8 as an induction furnace, it will be possible at the same time to feed the preheating energy to the pipes at a high consistency of performance. It is also advantageous, that the temperature equalization processes in the pipe material, introduced with the conveyance of heat in the pipe walls in consequence of the preheating process, have faded at the end of the continuous heating furnace 5 already to the point that the quantity of heat fed to the pipe material has been distributed largely homogeneously in the pipe material. Therefore the entire installation or its length may be dimensioned simply such, that the quantities of heat, fed to the pipe material through the furnaces 5 and 8, are distributed largely uniformly over the cross section of material at the point of reference of the furnace installation, preferably therefore at the exit of the continuous heating furnace 5.

The use of the process of the invention is not limited to the tempering of steel pipes, described in the embodiment. Rather, it is applicable to any heating up process to be carried out by means of a heating route, insofar as the pipes that are to be heated, because of their fluctuating structure (different dimensions, different pipe material, different pre-temperature) have a variable heat requirement and at a constant speed of conveyance through the continuous heating furnace, are to be heated to the same final temperature.

We claim:

1. A process for heating at least two metal pipes of finite length comprising the steps of:

determining the temperature of said pipes;

determining the thickness of the walls of said pipes;

pre-heating each of said pipes in a continuous pass through process in a manner responsive to said temperature determining step and said thickness determining step so as to equalize the variable heating requirements of each of said pipes so that at the end of said process each of said pipes has substantially the same temperature; and uniformly heating said pipes after said pre-heating step so that said pipes sequentially pass through the heating route with no more than a small distance between them in the longitudinal direction and at an equal speed of conveyance in such a way that said heating step will heat at least partial lengths of two immediate successive pipes simultaneously.

2. A process as in step 1 wherein said steps of preheating said pipes in a continuous pass through process comprises the step of inductively heating said pipe.

* * * * *